US008991385B2

(12) United States Patent
Kwon et al.

(10) Patent No.: US 8,991,385 B2
(45) Date of Patent: Mar. 31, 2015

(54) COOKING APPLIANCE

(75) Inventors: Jung-Ju Kwon, Changwon (KR); In-Sik Min, Changwon (KR); Sang-Min Lyu, Changwon (KR); Seong-Sig Cho, Changwon (KR)

(73) Assignee: LG Electronics Inc., Seoul (KR)

( * ) Notice: Subject to any disclaimer, the term of this patent is extended or adjusted under 35 U.S.C. 154(b) by 1067 days.

(21) Appl. No.: 12/746,396

(22) PCT Filed: Dec. 5, 2008

(86) PCT No.: PCT/KR2008/007237

§ 371 (c)(1),
(2), (4) Date: Aug. 20, 2010

(87) PCT Pub. No.: WO2009/072853

PCT Pub. Date: Jun. 11, 2009

(65) Prior Publication Data

US 2010/0307476 A1 Dec. 9, 2010

(30) Foreign Application Priority Data

Dec. 5, 2007 (KR) ..... 10-2007-0125839

(51) Int. Cl.

| | |
|---|---|
| ***F24C 3/04*** | (2006.01) |
| ***F24C 3/06*** | (2006.01) |
| ***F24C 3/12*** | (2006.01) |

(52) U.S. Cl.

CPC ..... *F24C 3/067* (2013.01); *F24C 3/126* (2013.01)

USPC ..... 126/37 A; 126/37 R; 126/39 H; 126/39 J; 126/39 K

(58) Field of Classification Search

USPC ... 126/39 H, 39 J, 39 K, 37 R, 37 A; 312/286

See application file for complete search history.

(56) References Cited

U.S. PATENT DOCUMENTS

| | | | | | |
|---|---|---|---|---|---|
| 2,870,828 | A | * | 1/1959 | Hess | 126/39 H |
| 2,908,267 | A | * | 10/1959 | Hess | 126/299 R |
| 3,376,861 | A | * | 4/1968 | Bach, Jr. | 126/37 R |
| 3,470,862 | A | * | 10/1969 | Morse et al. | 126/39 J |
| 3,606,612 | A | * | 9/1971 | Reid | 431/281 |

(Continued)

FOREIGN PATENT DOCUMENTS

| | | | |
|---|---|---|---|
| EP | 627599 | A2 * | 12/1994 |
| JP | 10-103621 | | 4/1998 |

(Continued)

OTHER PUBLICATIONS

Korean Office Action dated Mar. 2, 2009 (10-2007-0125835).

(Continued)

*Primary Examiner* — Jorge Pereiro
(74) *Attorney, Agent, or Firm* — Ked & Associates, LLP

(57) ABSTRACT

Embodiments provide a cooking appliance. The cooking appliance includes: a cabinet; a burner assembly provided within the cabinet, for combusting a gas mixture of air and gas; a nozzle assembly for supplying gas to the burner assembly; an exhaust passage in which combusted gas generated during combusting of the gas mixture flows; an intake passage in which air for mixing with the gas flows; and a top plate provided above the burner assembly, wherein combusted gas in the exhaust passage is exhausted to an outside through natural convection, and air outside the cabinet is drawn into the intake passage through natural convection.

15 Claims, 8 Drawing Sheets

(56) References Cited

U.S. PATENT DOCUMENTS

| | | | | | |
|---|---|---|---|---|---|
| 3,627,986 | A | * | 12/1971 | Anderson | 219/452.12 |
| 4,141,336 | A | * | 2/1979 | Fitch | 126/502 |
| 4,551,600 | A | * | 11/1985 | Miyagawa et al. | 219/623 |
| 4,616,562 | A | * | 10/1986 | Kuechler | 454/66 |
| 4,665,893 | A | * | 5/1987 | Miyagawa et al. | 126/299 D |
| 5,139,007 | A | * | 8/1992 | Bertomeu Martinez | 126/39 J |
| 5,509,403 | A | * | 4/1996 | Kahlke et al. | 126/39 E |
| 5,860,409 | A | * | 1/1999 | Grandveau et al. | 126/39 R |
| 6,172,338 | B1 | * | 1/2001 | Barnes et al. | 219/399 |
| 6,389,960 | B1 | * | 5/2002 | Williams et al. | 99/339 |
| 6,758,207 | B1 | * | 7/2004 | Hotard et al. | 126/41 R |
| 8,003,925 | B2 | * | 8/2011 | Okada | 219/623 |
| 2004/0096795 | A1 | * | 5/2004 | Abbasi et al. | 432/20 |
| 2005/0095547 | A1 | * | 5/2005 | Pottenger et al. | 431/354 |
| 2008/0149090 | A1 | * | 6/2008 | Lee et al. | 126/39 E |

FOREIGN PATENT DOCUMENTS

| | | | | |
|---|---|---|---|---|
| JP | 2002-39546 | | | 2/2002 |
| JP | 2005274037 | A | * | 10/2005 |
| JP | 2006329510 | A | * | 12/2006 |
| KR | 10-2002-0056248 | | | 7/2002 |
| KR | 10-2002-0056254 | | | 7/2002 |
| KR | 10-2003-0041270 | | | 5/2003 |
| KR | 10-2003-50295 | | | 6/2003 |
| KR | 10-0402620 | | | 10/2003 |
| KR | 10-2005-0086371 | | | 8/2005 |
| KR | 10-2006-0032359 | | | 4/2006 |
| KR | 10-0628160 | | | 9/2006 |
| KR | 10-0688360 | | | 2/2007 |
| KR | 10-0776446 | | | 11/2007 |

OTHER PUBLICATIONS

Korean Office Action dated Mar. 2, 2009 (10-2007-0125839).

Korean Office Action dated Jul. 1, 2009 (10-2007-0125834).

International Search Report issued in PCT/KR2008/007234 dated Jul. 14, 2009.

International Search Report issued in PCT/KR2008/007235 dated Jul. 17, 2009.

Korean Notice of Allowance dated Jul. 17, 2009.

Korean Notice of Allowance dated Nov. 2, 2009.

Korean Notice of Allowance dated Dec. 2, 2009.

* cited by examiner

COOKING APPLIANCE

TECHNICAL FIELD

Present embodiments relate to a cooking appliance.

BACKGROUND ART

A cooking appliance is a household appliance that uses gas, electricity, etc. to heat food.

In general, a cooking appliance that uses gas is provided with a plurality of burners on its top surface, and directly heats food by heating a vessel in which the food is stored with flames generated from combustion of gas at the burners. The flames generated from the cooking appliance are exposed to the outside.

DISCLOSURE OF INVENTION

Technical Problem

Embodiments provide a cooking appliance configured so that it can be used safely.

Embodiments also provide a cooking appliance with enhanced operational reliability.

Embodiments further provide a cooking appliance with a simplified structure.

Technical Solution

In one embodiment, a cooking appliance includes: a cabinet; a burner assembly provided within the cabinet, for combusting a gas mixture of air and gas; a nozzle assembly for supplying gas to the burner assembly; an exhaust passage in which combusted gas generated during combusting of the gas mixture flows; an intake passage in which air for mixing with the gas flows; and a top plate provided above the burner assembly, wherein combusted gas in the exhaust passage is exhausted to an outside through natural convection, and air outside the cabinet is drawn into the intake passage through natural convection.

In another embodiment, a cooking appliance using gas as fuel to generate heat, including: an intake through which outside air is drawn in; a combusting unit for combusting a gas mixture of the gas and the drawn in air; a gas supply unit for supplying gas to the combusting unit; an exhaust guide for guiding exhausting of combusted gas generated during combusting of the gas mixture in the combusting unit; and an exhaust provided proximate to the intake, for exhausting the combusted gas to the outside.

In a further embodiment, a cooking appliance built-in a cupboard, including: an intake for drawing in an outside fluid, the intake being located on an outwardly-exposed side of the cooking appliance in a state where the cooking appliance is installed on the cupboard; an intake passage in which fluid drawn in through the intake flows; a combustion portion for combusting a gas mixture of the drawn in fluid and gas; an exhaust for exhausting the combusted gas in the exhaust passage, the exhaust being located on an outwardly-exposed side of the cooking appliance in a state where the cooking appliance is installed on the cupboard.

Advantageous Effects

According to embodiments, through mixing, combusting, igniting, and exhausting gas mixture in a single burner assembly, a product with a simplified structure can be realized.

Also, because the length of a mixing tube, in which gas and air are mixed to form a gas mixture, is extended by a guide tube, efficiency of mixing the gas mixture can be retained while the size of a burner assembly can be reduced.

Further, because a barrier is provided to block the transfer of heat from combusted gas in an exhaust passage to an intake passage, gas can be stably supplied from a nozzle assembly to a burner assembly.

Additionally, because an intake and an exhaust are integrally formed, the aesthetics of the cooking appliance are improved, and its structure is simplified.

Moreover, because an intake passage and an exhaust passage extend in alignment, the lengths of the respective passages can be shortened, and space utilization within the cabinet can be improved.

MODE FOR THE INVENTION

Embodiments will be described in detail below, with reference to the drawings.

Figure 1:
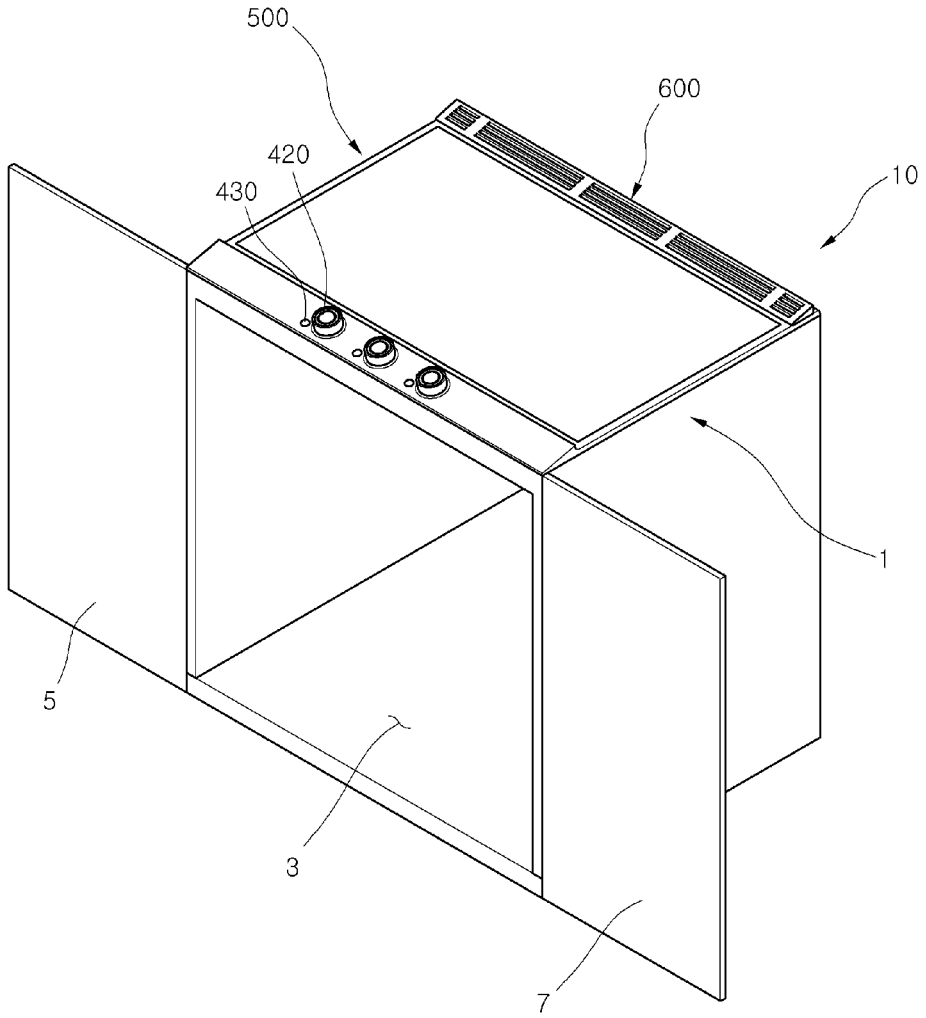
FIG. 1 is a perspective view of a cooking appliance in use according to present embodiments.
Figure 2:
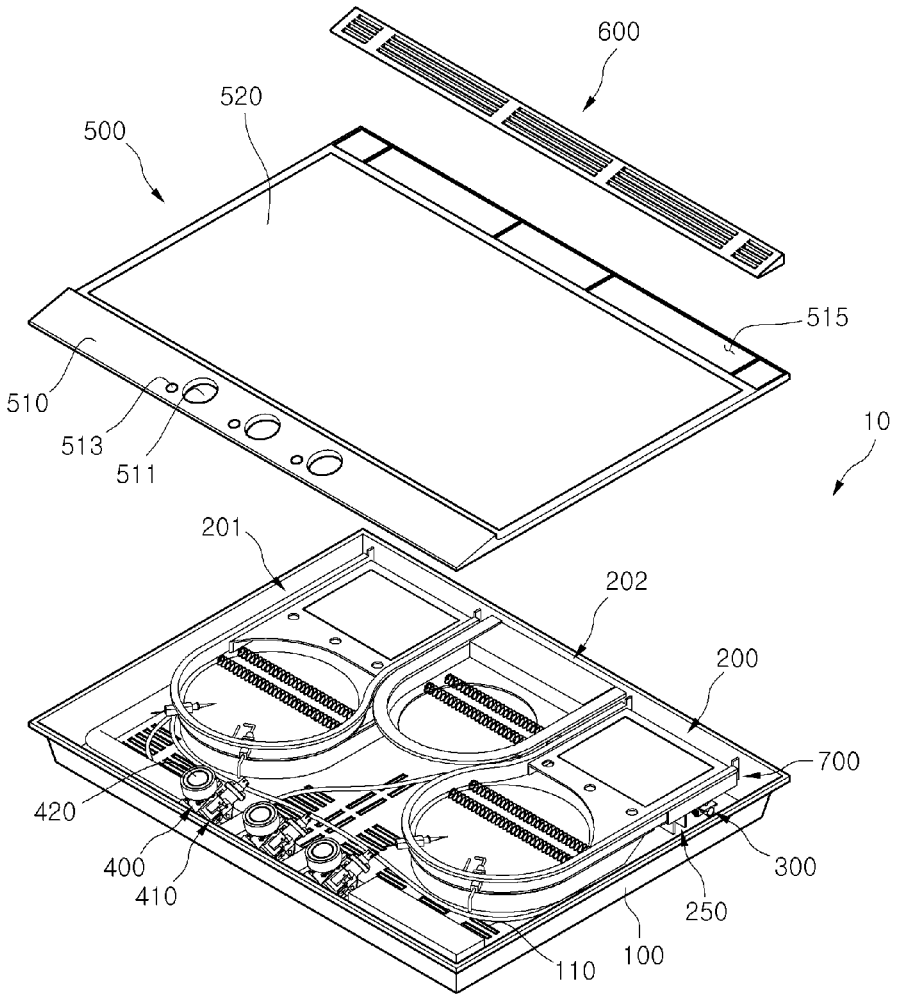
FIG. 2 is an exploded perspective view of a cooking appliance according to present embodiments.

FIG. 1 is a perspective view of a cooking appliance in use according to present embodiments, and FIG. 2 is an exploded perspective view of a cooking appliance according to present embodiments.

Referring to FIGS. 1 and 2, a cooking appliance according to present embodiments will be exemplarily described as a built-in appliance.

A cooking appliance 10 according to present embodiments is installed in a cupboard 1. The cupboard 1 has an installation space 3 defined within, and the front and top of the cupboard 1 are open. The cooking appliance 10 is installed in the top opening of the cupboard 1.

The cupboard 1 includes a pair of doors 5 and 7 that open and close the front opening of the cupboard 1.

The cooking appliance 10 includes a cabinet 100 and a top cover 500 that define its exterior. The cabinet 100 is formed hexahedral in shape with the top open. The top cover 500 seals the open top of the cooking appliance 10.

A plurality of cooling holes 110 is defined in the floor of the cabinet 100. Air for cooling components provided within the cabinet 100 can flow through the cooling holes 110 into the cabinet 100 or be discharged to the outside. Also, a cooling passage P3 (in FIG. 14), through which air that passes through the cooling holes 110 flows, is provided within the cabinet 100.

Below, a detailed description on the inner structure of the cooking appliance will be provided.

Referring to FIG. 2, the inside of the cabinet 100 is provided with a plurality of burner assemblies 200, 201, and 202 for mixing gas and air and combusting the gas mixture, and a controller 400 for controlling the operation of a plurality of nozzle assemblies 300 for discharging gas and the plurality of burner assemblies 200, 201, and 202.

The plurality of burner assemblies 200, 201, and 202 simultaneously combusts a gas mixture and guides the flow of combusted gas generated from the combusting of air and mixing gas that form the gas mixture.

The plurality of nozzle assemblies 300 supplies gas to the burner assemblies 200, 201, and 202. That is, each nozzle assembly 300 functions as a gas supply portion 300. The controller 400 controls the operation of the burner assemblies 200, 201, and 202 and the nozzle assemblies 300.

The plurality of burner assemblies 200, 201, and 202 includes 3 burner assemblies—that is, a first to third burner assembly 200, 201, and 202.

The first and second burner assemblies 200 and 201 are installed inside the cabinet 100 at the right and left, respectively, in the drawing. The third burner assembly 202 is installed between the first and second burner assemblies 200 and 201, or, at the central portion within the cabinet 100. The first to third burner assemblies 200, 201, and 202 may be formed in different sizes.

While the present embodiment describes three burner assemblies provided in the cabinet 100, there is no restriction to the number of burner assemblies, and at least one burner assembly may be provided in the cabinet 100.

The first through third burner assemblies 200, 201, and 202 are each connected at the rear to a connecting bracket 700 and fixed within the cabinet 100.

The connecting bracket 700 includes, at the left and right thereof, an elongated rectangular fixing portion 710 (in FIG. 11) and a flow guide 720 (in FIG. 11) extending vertically from the rear of the fixing portion 710.

The first to third burner assemblies 200, 201, and 202 are fixed to the fixing portion 710. The flow guide 720 partitions a passage for air drawn in and a passage for combusted gas through a flow guide unit 600 (to be described below), while also guiding the flow of the air and the combusted gas. That is, the flow guide 720 defines portions of an exhaust passage P2 (in FIG. 11) and an intake passage P1 (in FIG. 11).

An exhaust guide 730 (in FIG. 11) is provided at the leading end of the flow guide 720. The exhaust guide 730 extends in a forward and upward incline.

The exhaust guide 730 prevents gas exhausted through an exhaust 620 (in FIG. 11, described below) from moving toward an intake 610.

The plurality of nozzle assemblies 300 includes three nozzle assemblies 300. The nozzle assemblies 300 supply gas received from an external gas supply source to the first to third burner assemblies 200, 201, and 202.

The controller 400 is installed at the front of the first to third burner assemblies 200, 201, and 202—or, at the inner front portion of the cabinet 100. The controller 400 includes three valve assemblies 410 for supplying and controlling the supplied amount of gas to the first to third burner assemblies 200, 201, and 202. A knob 420 is coupled to each valve assembly 410, respectively. The knob 420 is a portion that a user grasps to control the valve assembly 410.

A light emitter 430 is provided on each valve assembly 410. The light emitter 430 is turned ON/OFF according to the operation of the valve assembly 410 to externally indicate whether the first to third burner assemblies 200, 201, and 202 are ignited.

The top cover 500 includes a top frame 510 and a top plate 520.

The front portion of the top frame 510 defines a plurality of knob through-holes 511 for the knob 420 of each valve assembly 410 to pass through. The front portion of the top frame 510 also defines a plurality of light emitter through-holes 513 for each of the light emitters 430 to pass through.

A plurality of openings 515 for intaking and exhausting air is defined at the rear portion of the top frame 510. Each opening 515 functions as a passage for intaking external air to be supplied to the respective burner assemblies 200, 201, and 202, and exhausting combusted gas generated from the combustion of gas mixture.

Specifically, external air is drawn in and internal combusted gas is exhausted to the outside through a single opening 515 in present embodiments. Here, an intake passage P1 (in FIG. 11) for external air and an exhaust passage P2 (in FIG. 11) for combusted gas are partitioned within the cabinet 100 by the flow guide 730, as described above.

The top plate 520 is installed on the top frame 510. The top plate 520 performs the function of transferring heat (generated in the combusting of gas mixture at the respective burner assemblies 200, 201, and 202) to food.

The top plate 520 may employ glass of a ceramic material as an example. Vessels containing food are placed on the top surface of the top plate 520. The top plate 520 may have vessel seats (not shown) formed thereon to indicate where to position vessels on.

The flow guide unit 600 is provided at the rear of the upper surface of the top frame 510. The flow guide unit 600 guides the intake of external air to be supplied to the respective burner assemblies 200, 201, and 202, and guides the exhausting of combusted gas from the respective burner assemblies 200, 201, and 202.

A detailed description of the structure of a burner assembly will be provided below.

Figure 3:
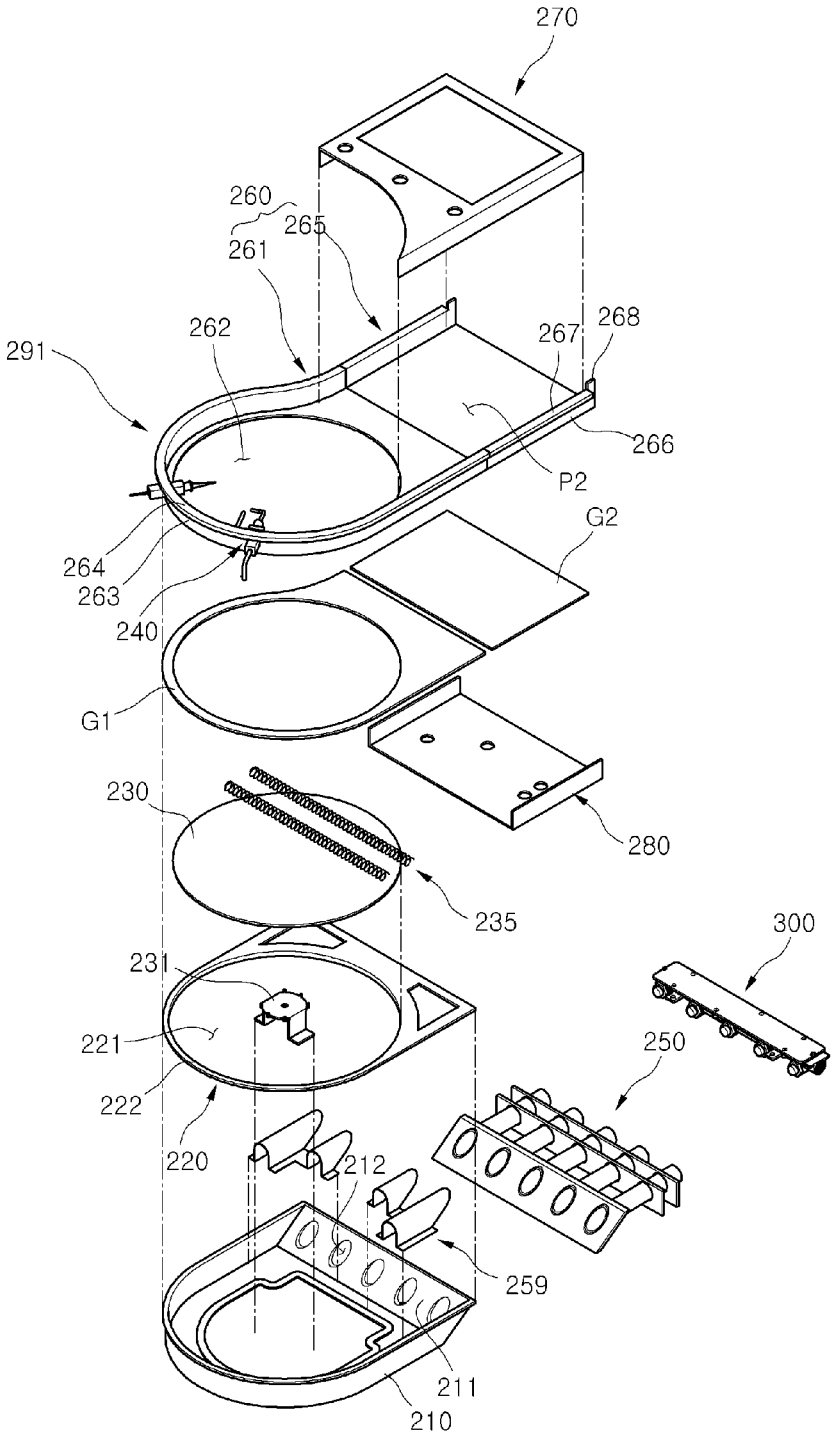
FIG. 3 is an exploded perspective view of a burner assembly according to present embodiments.
Figure 4:
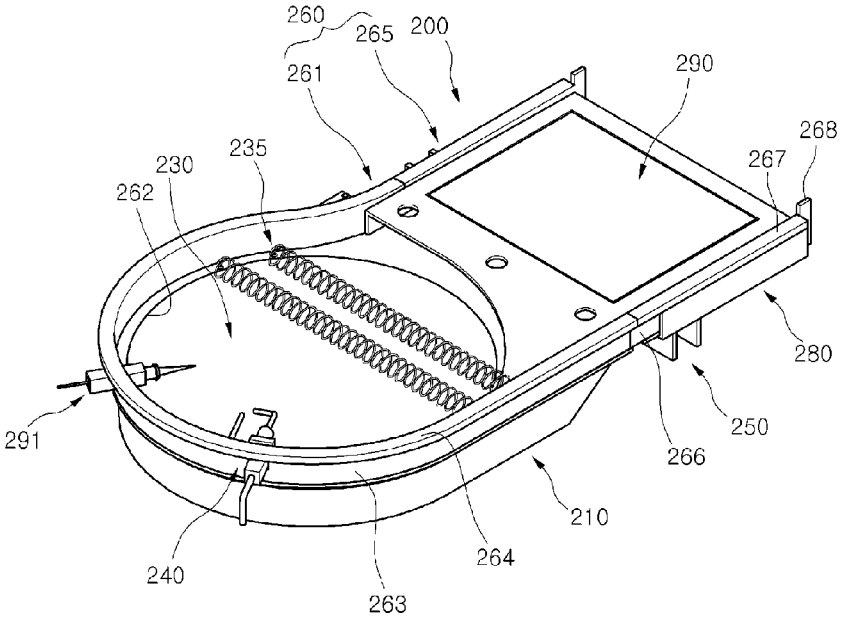
FIG. 4 is a top perspective view of a burner assembly according to present embodiments.
Figure 5:
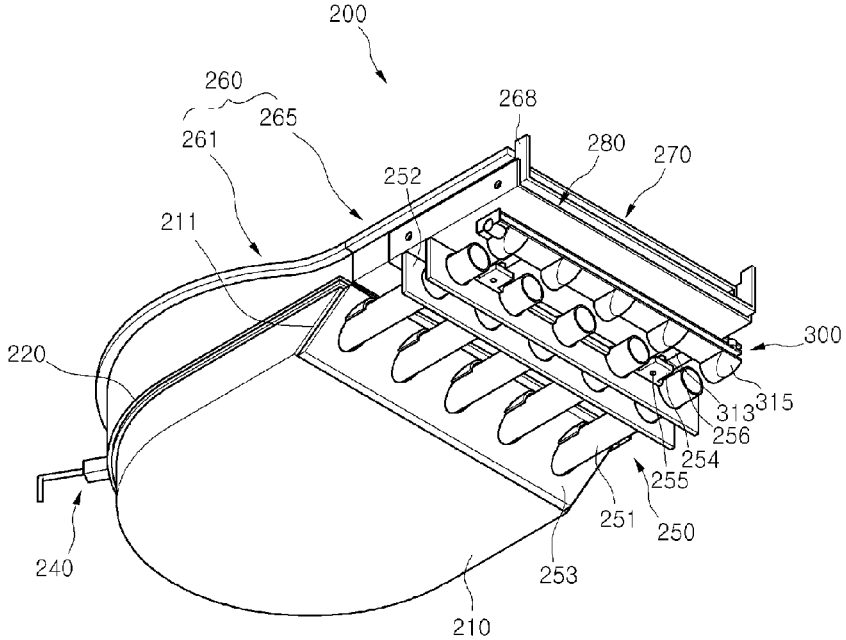
FIG. 5 is a bottom perspective view of a burner assembly according to present embodiments.

FIG. 3 is an exploded perspective view of a burner assembly according to present embodiments, FIG. 4 is a top perspective view of a burner assembly according to present embodiments, and FIG. 5 is a bottom perspective view of a burner assembly according to present embodiments.

Referring to FIGS. 3 to 5, because the first to third burner assemblies 200, 201, and 202 are the same in all other aspects but size, with respect to the first to third burner assemblies 200, 201, and 202, only a description of the first burner assembly 200 (hereinafter referred to as 'burner assembly' for descriptive convenience) will be provided.

The burner assembly 200 includes a combusting unit, an igniting unit, a mixing unit, and an exhaust guide unit.

The combusting unit is a region in which gas mixture is combusted, and includes a burner pot 210, a pot cover 220, and a combustion mat 230.

The igniting unit generates a spark to combust gas mixture in the combusting unit. A plug assembly 240 is included in the igniting unit.

The mixing unit mixes gas and air and supplies the gas mixture. The mixing unit includes a tube assembly 250 and a guide tube 259.

The exhaust guide unit guides the exhausting of combusted gas generated from combusting of the gas mixture in the combusting unit. The exhaust guide unit includes a burner frame 260, an upper barrier 270, and a lower barrier 280.

In detail, the burner pot 210 is formed with an open top. Gas mixture is supplied into the burner pot 210.

A sloped surface 211 is provided at the rear of the burner pot 210. The sloped surface 211 is formed extending downward in a slope from the top of the burner pot 210.

The sloped surface 211 defines a plurality of gas mixture supply holes 212. FIG. 3 shows five gas mixture supply holes 212 as an example.

The pot cover 220 seals the open top of the burner pot 210. Also, a gas mixture guide hole 211 is defined in the pot cover 220 to guide gas mixture supplied into the burner pot 210 to the combustion mat 230. Thus, because portions of the pot cover 220 other than the gas mixture guide hole 211 seal the top of the burner pot 210 to guide gas mixture to the combustion mat, these can be referred to as a guide member.

The pot cover 220 defines a mat seat 222. The mat seat 222 of the pot cover 220 is defined by a portion of the pot cover 220 that is stepped downward.

The combustion mat 230 is a region where combustion of gas mixture actually occurs. The combustion mat 230 is seated on the mat seat 222. Here, the top surface of the combustion mat 230 may be disposed on the same plane as the upper surface of the pot cover 220. The combustion mat 230 may be formed of a ceramic material.

A combustion obstructing member 231 is provided within the burner pot 210. The combustion obstructing member 231 obstructs (or reduces) combustion of gas mixture at the central portion of the combustion mat 230.

Specifically, the combustion obstructing member 231 prevents damage to the top plate 520 and/or a vessel from heat being concentrated in the space between the top plate 520 and the undersurface of the vessel (when cooking food inside a vessel such as a ceramic bowl that curves upward from its bottom).

The combustion obstructing member 231 is seated on the burner pot 210, and is attached to the center of the bottom surface of the combustion mat 230 to prevent combustion of gas mixture at the central portion of the combustion mat 230, or is proximate to the center of the bottom surface of the combustion mat 230 to reduce combustion of gas mixture.

The tube assembly 250 includes a plurality of mixing tubes 251, a plurality of air barriers 252, and a sealing portion 253.

The mixing tube 251 is where mixing of gas and air actually occurs, and also guides the gas mixture to the burner pot 210. The mixing tube 251 is formed in a cylindrical shape having a diameter corresponding to the diameter of the gas mixture supply hole 212 when parallelly projected. The front of each mixing tube 251 is sloped corresponding to the slope of the sloped surface 211.

The plurality of air barriers 252 is provided laterally elongated at the rear portions of the mixing tubes 251. The plurality of air barriers 252 is separated from front-to-rear.

The air barriers 252 prevent air that is drawn into the cabinet 100 through the cooling holes 110 from flowing toward the nozzle assembly 300.

In detail, with reference to FIG. 1, when the doors 5 and 7 of the cupboard 1 are being open and shut, a large volume of air may enter the installation space 3. The air that enters the installation space 3 enters into the cabinet 100 through the cooling holes 110. If the air that enters the cabinet 100 flows toward the nozzle assembly 300, the air around the nozzle assembly 300 and the air discharged from the nozzle assembly 300 impede flow to the respective mixing tubes 251.

According to present embodiments, however, the air entering into the cabinet 100 through the cooling holes 110 can be blocked from flowing toward the nozzle assembly 300 by means of the air barrier 252.

Also, the plurality of mixing tubes 251 is coupled to the air barriers 252. The sealing portion 253 is connected to the front end of each mixing tube 251.

The sealing portion 253 has the same sloped angle as the sloped surface 211 so that it can be sealed with the sloped surface 211. Accordingly, leaking of gas mixture supplied from the respective mixing tubes 251 to the burner pot 210 can be prevented.

While pressed against the sloped surface 211, the sealing portion 253 is fastened thereto by means of a fastening member (not shown).

The tube assembly 250 includes a plurality of fastening ribs 244 to fasten it to the nozzle assembly 300. The plurality of fastening ribs 244 is formed on the air barrier 252. A fastening hole 255 is defined in each of the fastening ribs 254. Also, a guide projection 256 is formed on the upper surface of each fastening rib 254 to couple with the nozzle assembly 300.

While not shown, a gasket may be provided at the region where the burner pot 210 and the tube assembly 250 are pressed together—that is, between the sloped surface 211 and the sealing portion 253.

The gasket prevents the gas mixture supplied from the tube assembly 250 to the burner assembly 200 from leaking through gaps.

The guide tube 259 is disposed within the burner pot 210. The guide tube 259 extends the length of the mixing tube 251 to increase mixing efficiency of gas and air.

That is, by increasing the physical distance over which gas and air to be mixed can flow, the guide tube 259 increases the mixing efficiency of gas and air.

The rear of the guide tube 259 is formed of a sloped angle corresponding to that of the sloped surface 211. In order to prevent the guide tube 259 from impeding combustion at the combustion mat 230, the guide tube 259 may be disposed not to vertically overlap the combustion mat 230.

The burner frame 260 is disposed above the combustion mat 230.

The burner frame 260 includes a first burner frame 261 and a second burner frame 265. The first burner frame 261 guides combusted gas generated from combusting of gas mixture at the combustion mat 230 to the second burner frame 265. The first burner frame 261 is fixed to the pot cover 220. Therefore, the first burner frame 261 and the pot cover 220 can fix the position of the combustion mat 230. The second burner frame 265 guides combusted gas to the flow guide unit 600.

A heat transfer hole 262 is defined in the central portion of the first burner frame 261 in order to facilitate transfer of heat generated during combustion of gas mixture at the combustion mat 230 to the top plate 520. The heat transfer hole 262 may be formed in a circular shape corresponding to the gas mixture guide hole 221.

The first burner frame 261 includes a guide rib 263 and a plate supporting rib 264. The guide rib 263 does not discharge combusted gas generated during combustion of gas mixture at the combustion mat 230, but guides the combusted gas to the second burner frame 265.

Also, the guide rib 263 does not diffuse heat generated during combustion of gas mixture at the combustion mat 230, but concentrates the heat toward the top plate 520.

The guide rib 263 extends from all bottom edges of the first burner frame 261, with the exception of the rear of the first burner frame 261.

The plate supporting rib 264 supports the undersurface of the top plate 520. The plate supporting rib 264 is formed extending outward from the guide rib 263 toward the outside of the first burner frame 261.

The second burner frame 265 is connected to the first burner frame 261. The second burner frame 265 may be integrally formed with the first burner frame 261, or may be formed separately from and coupled to the first burner frame 261.

The second burner frame 265 includes a guide rib 266 and a plate supporting rib 267. The guide rib 266 extends upward the same height as the guide rib 263 of the first burner frame 261 at either side of the second burner frame 265.

The plate supporting rib 267 is formed extending to either side from the upper ends of each guide rib 266. Also, the plate supporting rib 267 supports the top plate 520.

The guide rib 266 is provided with a partitioning rib 268 at a rear thereof. The partitioning rib 268 extends upward from the guide rib 266.

The partitioning rib 268 prevents combusted gas generated in the respective burner assemblies 200, 201, and 202 from mixing inside the cabinet.

A plurality of hot wires 235 is provided above the combustion mat 230. The hot wires 235 allow easy discernment from the outside of whether gas mixture is being combusted in the burner assembly 200.

When the hot wires 235 change color from being raised in temperature by combustion of gas mixture at the combustion mat 230, a user is able to discern that gas mixture is being combusted in the burner assembly 200.

Both ends of the hot wire 235 are fixed to the first burner frame 261. The hot wire 235 is extended and fixed to the first burner frame 261. This is to prevent the hot wire 235 from being extended by heat and contacting the combustion mat 230.

An intake passage P1 (in FIG. 11) is provided below the burner frame 260 inside the cabinet 110. Air to be supplied to the burner assembly flows in the intake passage P1.

In present embodiments, the intake passage P1 is actually defined by the floor of the cabinet 100 and the lower surface of the second burner frame 265.

The upper barrier 270 is seated on the second burner frame 265 and disposed between the top plate 520 and the second burner frame 265. The upper barrier 270 is formed in a U-shape.

In present embodiments, the second burner frame 265 and the upper barrier 270 define the exhaust passage P2 through which combusted gas flows. However, the upper barrier 270 may be removed, and the exhaust passage P2 may be defined by the second burner frame 265 and the top plate 520.

The upper barrier 270 transfers a portion of heat from combusted gas flowing through the exhaust passage P2—specifically, an amount of heat sufficient to warm food—to the top plate 520.

Accordingly, the top plate 520 above the exhaust passage P2 defines a warm zone that can warm food with heat from combusted gas flowing through the exhaust passage P2.

The lower barrier 280 is coupled at the bottom of the second burner frame 265. A portion of the lower barrier 280 is disposed between the second burner frame 265 and the tube assembly 250, and another portion is disposed between the second burner frame 265 and the nozzle assembly 300.

The lower barrier 280 prevents heat from combusted gas flowing through the exhaust passage P2 from being transferred to the tube assembly 250 and the nozzle assembly 300. The lower barrier 280 is formed in a U-shape, with either side surface pressed against the guide rib 266 of the second burner frame 265.

Gaskets G1 and G2 are provided between the pot cover 220 and the first burner frame 261, and the second burner frame 265 and the lower barrier 280, respectively.

The gasket G1 prevents gas leakage through gaps between the pot cover 220 and the first burner frame 261.

The gasket G2 prevents heat exchange between the second burner frame 265 and the lower barrier 280.

With the burner pot 210, pot cover 220, combustion mat 230, gasket G1, and burner frame 260 stacked vertically, the burner pot 210 and the burner frame 260 are fixed with a fastening member (not shown), to assemble the burner assembly 200.

Here, the upper barrier 270 is seated on the top surface of the burner frame 260, and the lower barrier 280 is fixed to the lower surface of the burner frame 260 by means of a fastening member (not shown).

Figure 6:
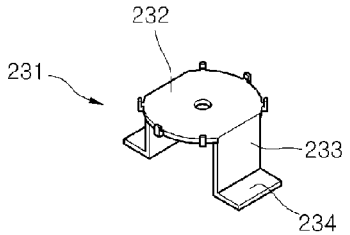
FIG. 6 is a perspective view of a combustion obstructing member that configures a burner assembly according to present embodiments.

FIG. 6 is a perspective view of a combustion obstructing member that configures a burner assembly according to present embodiments.

Referring to FIGS. 3 and 6, the combustion obstructing member 231 includes an obstructing portion 232, a plurality of supporting portions 233, and a plurality of fixing portions 234.

The obstructing portion 232 is formed in the shape of a round plate. The obstructing portion 232 is pressed against the central portion on the lower surface of the combustion mat 230, or is separated a predetermined distance from the central portion on the lower surface of the combustion mat 230.

Each of the plurality of supporting portions 233 extends downward from the obstructing portion 232 to support the obstructing portion 232 at a predetermined height from the floor of the burner pot 210. That is, the obstructing portion is separated from the floor of the burner pot 210. Thus, the flow of gas mixture supplied into the burner pot 210 is unimpeded by the combustion obstructing member 231.

The fixing portions 234 extend in mutually divergent directions at the bottoms of the supporting portions 233. The respective fixing portions 234 are fixed to the floor of the burner pot 210 by means of separate fastening members, welding, etc.

Figure 7:
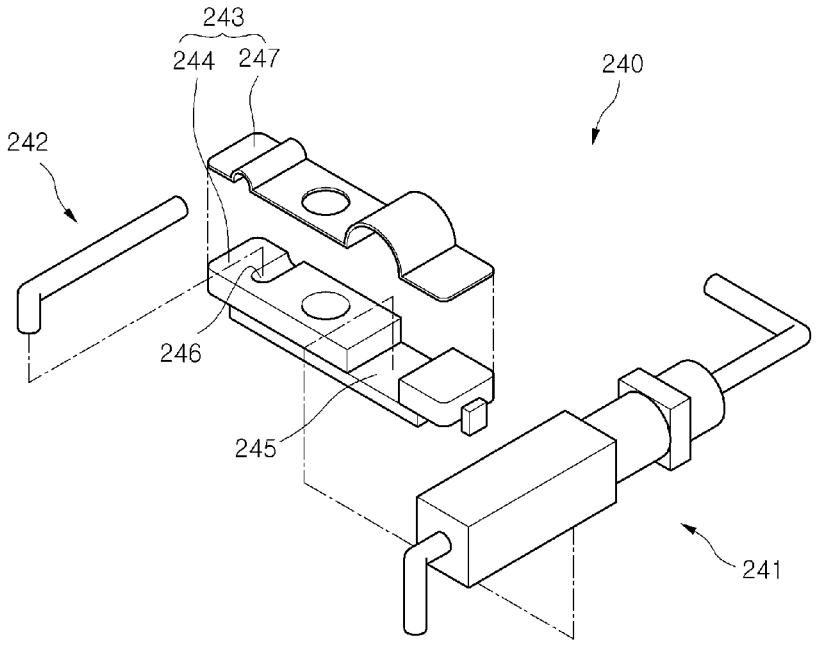
FIG. 7 is an exploded perspective view of a plug assembly that configures a burner assembly according to present embodiments.

FIG. 7 is an exploded perspective view of a plug assembly that configures a burner assembly according to present embodiments.

Referring to FIGS. 3 and 7, the plug assembly 240 includes a spark plug 241, a plug target 242, and a plug holder 243. The spark plug 241 and the plug target 242 generate a spark for igniting the gas mixture.

The plug target 242 is formed of metal, and is spaced a predetermined gap from the spark plug 241. When power is applied to the spark plug 241, a spark is generated between the spark plug 241 and the plug target 242.

The spark plug 241 and the plug target 242 are installed on the plug holder 243. The plug holder 243 is fixed to the first burner frame 261. The spark plug 241 and the plug target 242 are mounted on the plug holder 243 and are passed through the first burner frame 261 to be disposed above the combustion mat 230.

A holder body 244 and a holder cover 247 are included on the plug holder 243. The holder body 244 forms a plug seat 245 in which a side of the spark plug 241 is seated, and a target insertion hole 246 in which an end of the plug target 242 is inserted.

With the spark plug 241 seated in the plug seat 245 and the plug target 242 inserted in the target insertion hole 246, the holder cover 247 is coupled to the top of the holder body 244.

The plug holder 243 is coupled to the first burner frame 261 by means of a fastening member. In present embodiments, the plug holder 243 is formed of metal. Accordingly, the plug holder 243 in which the plug target 242 is inserted is fixed to the first burner frame 261, so that the plug assembly 240 can be grounded without the use of a separate ground wire.

Figure 8:
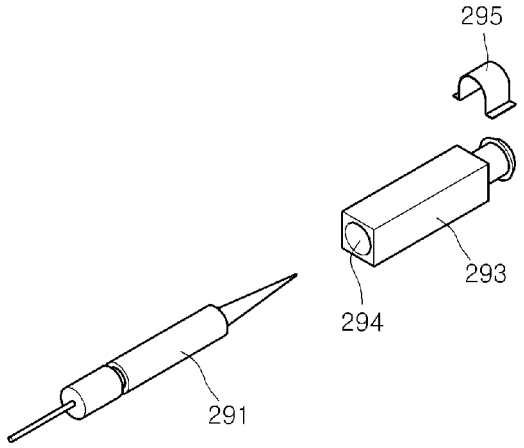
FIG. 8 is an exploded perspective view of a thermocouple and protective member that configure a burner assembly according to present embodiments.

FIG. 8 is an exploded perspective view of a thermocouple and protective member that configure a burner assembly according to present embodiments.

Referring to FIGS. 3 and 8, a thermocouple 291 is installed on the first burner frame 261.

The thermocouple 291 is passed through the first burner frame 261, and has a portion thereof disposed within the first burner frame 261 and another portion disposed outside the first burner frame 261.

While gas mixture is being combusted on the combustion mat 230, the temperature difference between the portion of the thermocouple 291 disposed within the first burner frame 261 and the portion disposed outside the first burner frame 261 generates a predetermined electromotive force.

Depending on the presence of electromotive force in the thermocouple 291, the valve assembly 410 that supplies gas is maintained in an open state, or the valve assembly 410 that is open is closed.

The thermocouple 291 is enclosed by a protective member 293. The protective member 293 is for protecting the portion of the thermocouple 291 disposed within the first burner frame 261. That is, the protective member 293 prevents damage to the thermocouple 291 from heat generated during combustion of combustion gas at the combustion mat 230. In present embodiments, in order to electrically insulate the thermocouple 291, an insulator formed of ceramic material may be used for the protective member 293.

The protective member 293 is formed in a hexahedral shape, and includes a through-hole 294 through which the thermocouple 291 is passed. One end of the protective member 293 is formed in an approximately cylindrical shape. The one end of the protective member 293 with the cylindrical shape has a bracket 295 (that fixes to the first burner frame 261) seated thereon.

Figure 9:
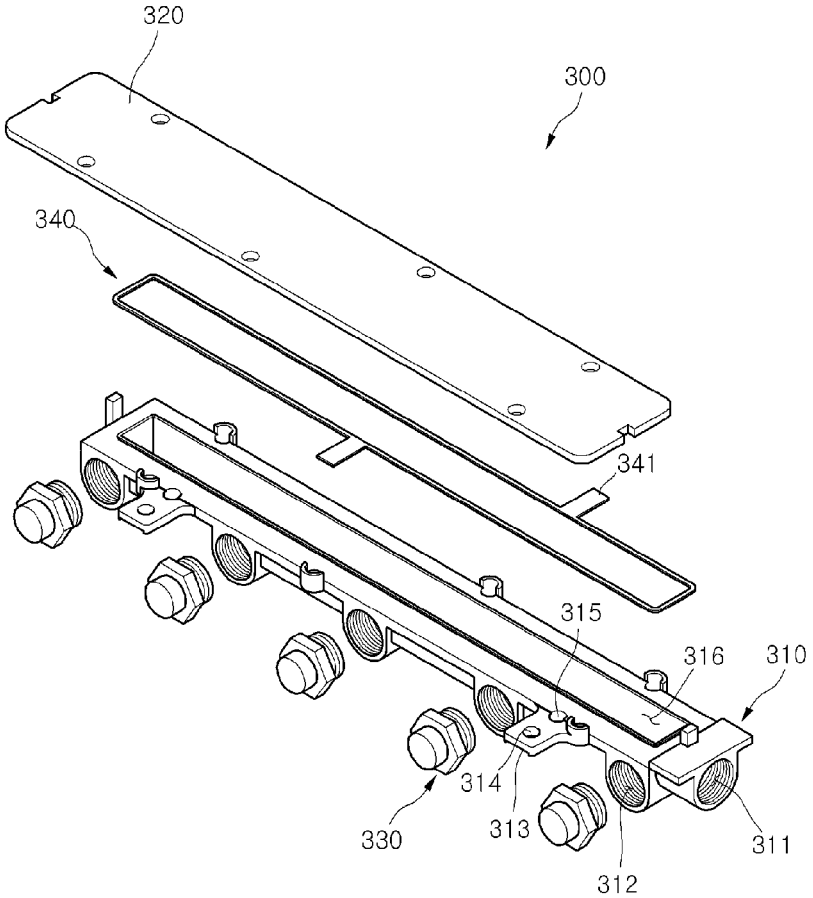
FIG. 9 is an exploded perspective view of a nozzle assembly according to present embodiments.

FIG. 9 is an exploded perspective view of a nozzle assembly according to present embodiments.

Referring to FIG. 9, the nozzle assemblies 300 according to present embodiments perform the function of supplying gas to each burner assembly 200, 201, and 202, respectively. In present embodiments, while the three nozzle assemblies 300 are provided in triplicate, because the structures of the respective nozzle assemblies 300 are all the same, description will be provided below of only one nozzle assembly 300.

The nozzle assembly 300 includes a nozzle body 310, a nozzle cover 320, a plurality of discharge nozzles 330, and a nozzle gasket 340.

The nozzle body 310 defines the exterior of the nozzle assembly 300. The nozzle body 310 has an open top. The nozzle body 310 includes a supply hole 311 to which an end of a gas hose (not shown) for connecting to the valve assembly 410 is connected, and a plurality of discharge holes 312 that couples with the discharge nozzles 330. The supply hole 311 is defined in one end of the nozzle body 310. The plurality of discharge holes 312 is formed in the front surface of the nozzle body 310 facing the rear of the tube assembly 250.

Screw threads are defined in the inner peripheries of the supply hole 311 and the plurality of discharge holes 312, for coupling with the gas hose and the discharge nozzles 330.

In order to minimize the quantity of material and the number of processes used for fabricating the nozzle body 310, the nozzle body 310 is formed through die casting aluminum, and the supply hole 311 and the discharge holes 312 are defined through tapping.

The nozzle cover 320 seals the open upper surface of the nozzle body 310. Thus, a predetermined space is formed between the nozzle body 310 and the nozzle cover 320. That is, the nozzle body 310 and the nozzle cover 320 define a gas receiving space. Also, the space 316 communicates with the supply hole 311 and the discharge hole 312.

Each of the discharge nozzles 330 discharges gas from the gas flow space 316 at high pressure toward the mixing tube 251. The discharge nozzles 330 are coupled to the discharge holes 312, respectively. In order to introduce air around the mixing tube 251 into the mixing tube together with gas when gas that is discharged from the discharge nozzle 330 flows to the mixing tube, the discharge nozzle 330 is separated from the rear of the mixing tube 251 when coupled to the discharge hole 312.

Screw threads are formed on the outer periphery of the discharge nozzle 330 to correspond to the screw threads of the discharge hole 312.

A plurality of fastening ribs 313 is formed on the first nozzle body 310. The fastening ribs extend forward from the front of the nozzle body 310—that is, toward the tube assembly 250. A through-hole 314 through which a fastening member (not shown) passes, and a guide hole 315 in which a guide projection 256 of the tube assembly 250 is inserted are defined in the fastening rib 313.

Accordingly, with the guide projection 256 inserted in the guide hole 315, a fastening member passed through the through-hole 314 is fastened to the fastening hole 255, in order to couple the tube assembly 250 and the nozzle assembly 300.

The nozzle gasket 340 is disposed between the nozzle body 310 and the nozzle cover 320. The nozzle gasket 340 seals the gap between the nozzle body 310 and the nozzle cover 320. That is, the nozzle gasket 340 prevents gas leaking through the gap between the nozzle body 310 and the nozzle cover 320.

Also, an identifying rib 341 is formed on the nozzle gasket 340. The identifying rib 341 allows a user to easily discern whether the nozzle gasket 340 is installed. With the nozzle gasket 340 installed between the first nozzle body 310 and the nozzle cover 320, the identifying rib 341 is exposed outside the nozzle assembly 300. When the identifying rib 341 is exposed outside the nozzle assembly 300, a user can discern that the nozzle gasket 340 has been installed in the nozzle assembly 300.

Figure 10:
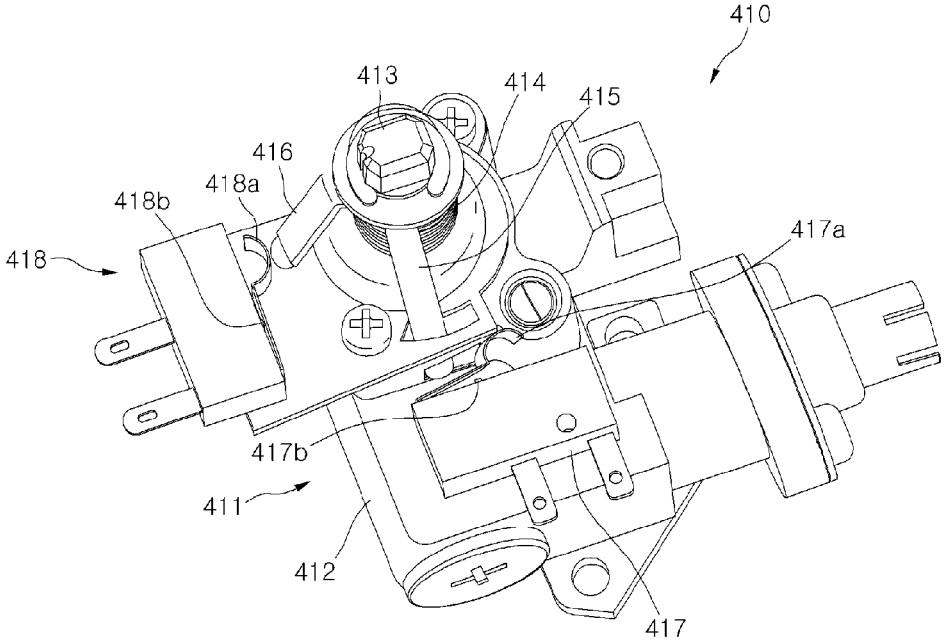
FIG. 10 is a perspective view of a valve assembly according to present embodiments.

FIG. 10 is a perspective view of a valve assembly according to present embodiments.

Referring to FIG. 10, the valve assembly 410 selectively supplies gas to the nozzle assembly 300 and the light emitter 430 is simultaneously turned ON/OFF.

The valve assembly 410 includes a valve 411, a first drive lever 415 and a second drive lever 416, an ON/OFF switch 417, and an ignition switch 418.

The valve 411 controls whether gas transferred through the nozzle assembly 300 is supplied and controls the supplied volume of gas. The valve 411 includes a valve body 412, a valve shaft 413, and a tensile member 414.

The valve body 412 includes a gas passage (not shown), and a pair of connecting holes (not shown) communicating with the gas passage. One of the pair of connecting holes has a gas hose (not shown) connected thereto for connecting to an external gas supply source (not shown). The other of the pair of connecting holes has a gas hose (not shown) connected thereto for connecting to the nozzle assembly 300.

Also, a plug (not shown) is provided within the valve body 412 to control the closed or opened degree of the valve 411. The controlling structure that controls the amount by which the valve 411 is closed and opened with the plug is well known, and thus, a detailed description thereof will not be provided.

The valve shaft 413 is rotatably installed in the valve body 412. A knob 420 and a plug are coupled at either end of the valve shaft 413, respectively. Thus, when a user presses the knob 420, the plug moves in a lengthwise direction of the valve shaft 413 to open the valve 411. Also, when a user rotates the knob 420 about the valve shaft 413 in a clockwise or counterclockwise direction (in the drawings), the plug controls the volume of gas that flows within the valve body 412.

In present embodiments, when the knob 420 is rotated clockwise, the plug increases the opened degree of the valve 411, and when the knob 420 is rotated counterclockwise, the plug decreases the opened degree of the valve 411.

The tensile member 414 imparts biasing force to the valve shaft 413 to move the plug in a closing direction of the valve 411.

Accordingly, when a user removes pressing force on the knob 420 in the lengthwise direction of the valve shaft 413, the valve shaft 413 is moved by means of the biasing force of the tensile member 414 so that the valve 411 is closed by the plug.

The first drive lever 415 and the second drive lever 416 rotate in relation to the rotation of the valve shaft 413. The first drive lever 415 turns the ON/OFF switch 417 ON/OFF, and the second drive lever 416 turns the ignition switch 418 ON/OFF.

In the present embodiment, when the valve shaft 413 in the drawing is rotated clockwise, the plug opens the passage in the valve body 412 to maximum, and the ON/OFF switch 417 is turned OFF, and the ignition switch 418 is turned ON.

The ON/OFF switch 417 generates an electrical signal for switching of the light emitter 430. The ON/OFF switch 417 includes a moving terminal 417*a* and a fixed terminal 417*b*. Accordingly, when the moving terminal 417*a* and the fixed terminal 417*b* are separated and OFF, the light emitter 430 is ON. Conversely, when the first drive lever 415 puts the moving terminal 417*a* in contact with the fixed terminal 417*b* to be ON, the light emitter 430 is turned OFF.

The ignition switch 418 generates an electrical signal for emitting a spark from the spark plug 241. The ignition switch 418 includes a moving terminal 418*a* and a fixed terminal 418*b*.

Accordingly, when the second drive lever 416 puts the moving terminal 418*a* and the fixed terminal 418*b* in contact to be ON, current is supplied to the spark plug 241 in order to generate a spark to combust gas mixture supplied to the burner assembly 200.

Figure 11:
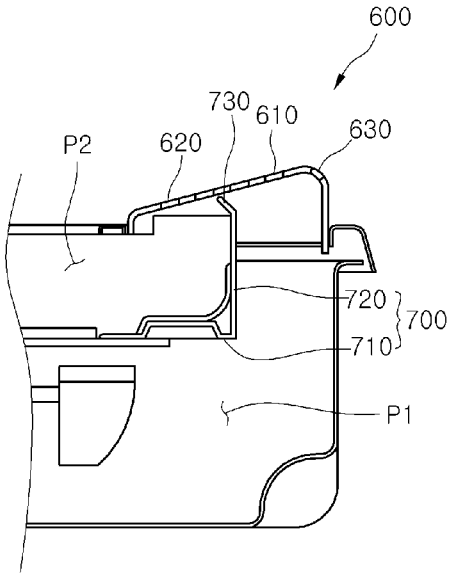
FIG. 11 is a partial, vertical side sectional view of a cooking appliance according to present embodiments.

FIG. 11 is a partial, vertical side sectional view of a cooking appliance according to present embodiments.

Referring to FIGS. 2 and 11, the flow guide unit 600 is formed laterally elongated.

The flow guide unit 600 includes a plurality of intakes 610 for intaking air from the outside, and a plurality of exhausts 620 for exhausting combusted gas to the outside.

The intakes 610 are disposed at the rear of the exhausts 620. Specifically, the intakes 610 are defined at the rear of the flow guide unit 600, and the exhausts 620 are provided at the top, front portion of the flow guide unit 600.

This separation of the intakes 610 and the exhausts 620 is physically achieved by the flow guide 720 of the connecting bracket 700.

Each of the intakes 610 communicates with the intake passage P1, and each of the exhausts 620 communicate with the exhaust passage P2.

Also, an auxiliary inlet hole 630 is defined at the rear upper end of the flow guide unit 600. Thus, external air passes through the intake 610 and the auxiliary air inlet hole 630 into the intake passage P1.

Figure 12:
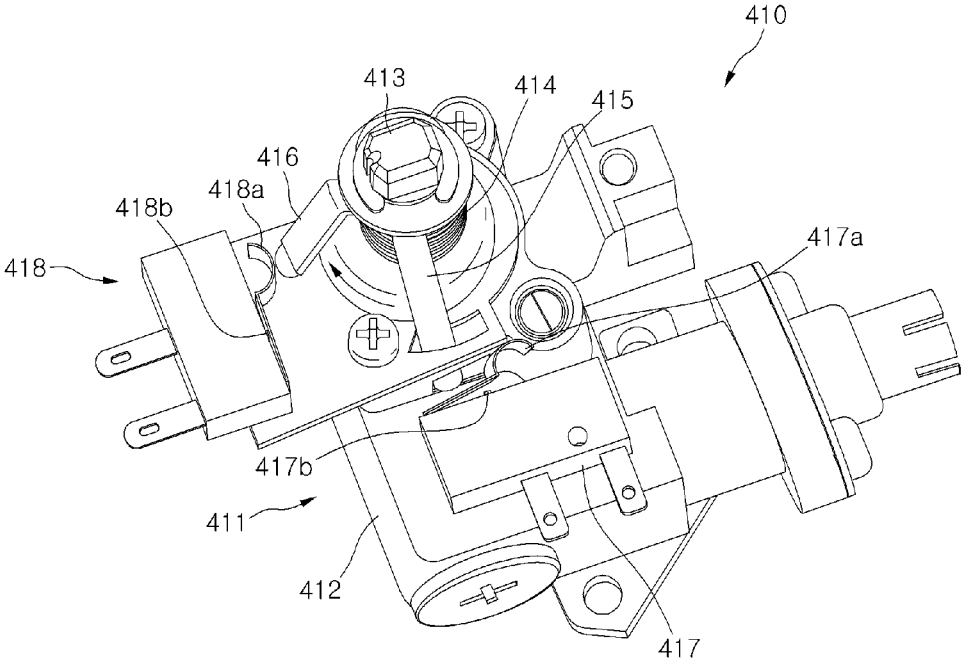
FIGS. 12 and 13 are views showing ON/OFF states of a valve assembly according to present embodiments.
Figure 13:
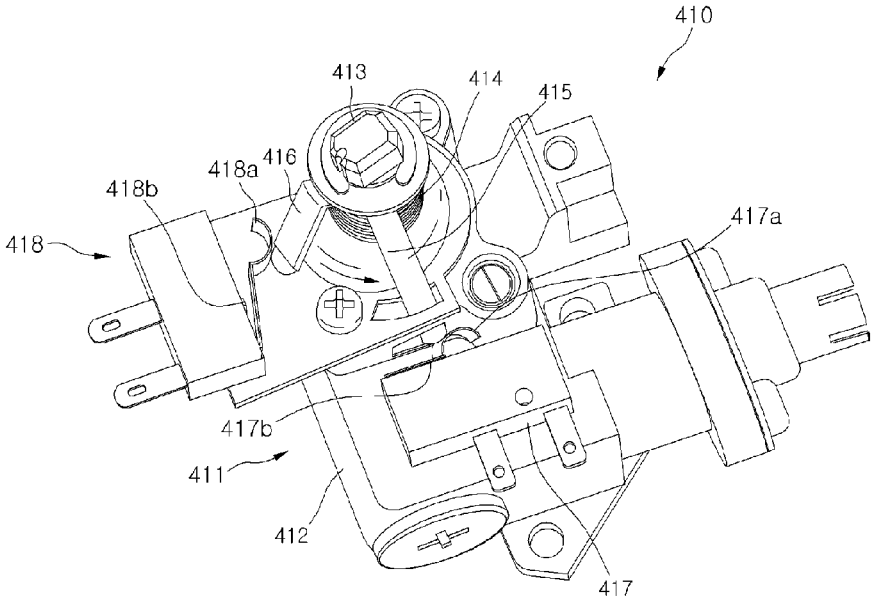
Figure 14:
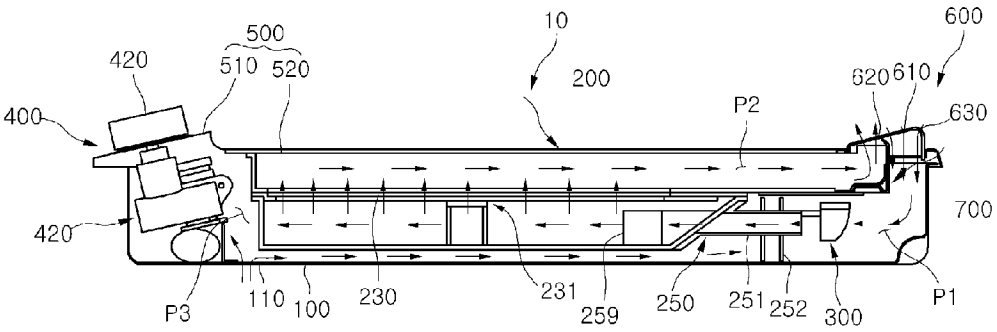
FIG. 14 is a vertical sectional view showing airflow within a cooking appliance according to present embodiments.

FIGS. 12 and 13 are views showing ON/OFF states of a valve assembly according to present embodiments, and FIG. 14 is a vertical sectional view showing airflow within a cooking appliance according to present embodiments.

Referring to FIGS. 1 to 14, with the valve 411 of the valve assembly 410 closed, the ON/OFF switch 417 is turned ON by the first drive lever 415. The ignition switch 418, on the other hand, is turned OFF.

Thus, gas is not supplied to the nozzle assembly 300, and the spark plug 241 does not generate a spark, while the light emitter 430 is retained in an OFF state.

As shown in FIG. 12, when a user rotates the knob 420 clockwise (in the drawings) to open the valve 411, the valve shaft 413 coupled to the knob 420 is also turned clockwise (in the drawings). Accordingly, the valve 411 is opened to begin supplying gas to the nozzle assembly 300.

The gas supplied to the nozzle assembly 300 mixes with air in the intake passage P1 to yield a gas mixture that is supplied through the tube assembly 250 to the burner assembly 200.

When the knob 420 is continuously turned clockwise (in the drawings), the valve shaft 413 is also continuously rotated clockwise. Then, when the opened degree of the valve 411 reaches its maximum point through clockwise rotation of the valve shaft 413, the second drive lever 416 turns the ignition switch 418 ON.

Thus, the gas mixture supplied to the first burner assembly 200 is ignited and combusted by means of a spark generated through a current supplied to the spark plug 241.

Also, when the valve 411 is maximally opened, the ON/OFF switch 417 is turned ON. Hence, the light emitter 430 is lit to enable a user to discern that combustion of gas mixture is occurring in the burner assembly 200.

When the gas mixture supplied to the burner assembly 200 is combusted through the spark generated by the spark plug 241, the knob 420 is rotated counterclockwise to control the opened degree of the valve 411.

Referring to FIG. 14, heat generated from combustion of gas mixture at the combustion mat 230 is transferred through the top plate 520 to a vessel seated atop the top plate 520. The vessel is thus heated to physically cook food contained in the vessel.

The hot combusted gas generated from the combustion of gas mixture at the combustion mat 230 flows through the exhaust passage P2. The combusted gas is exhausted through the exhausts 620 of the flow guide unit 600 communicating with the exhaust passage P2. The guide portion 720 of the connecting bracket 700 guides combusted gas exhausted through the exhausts 620 in a forward direction. Therefore, the combusted gas exhausted through the exhausts 620 is prevented from contaminating wall surfaces at the rear—that is—kitchen wall surfaces.

Here, because the combusted gas is of higher temperature and pressure than air outside the cooking appliance, it is exhausted by means of convection through the exhausts 620 to the outside of the cooking appliance at which there is low pressure (atmospheric pressure).

Conversely, gas discharged through the discharge nozzle 330 flows into the tube assembly 250 at high velocity. Here, because gas that passes the mixing tube 251 of the tube assembly 250 is high in velocity, the pressure of the space around the air inlet holes of the flow guide unit 600 is lower than atmospheric pressure (pressure outside the cooking appliance) due to Bernouilli's principle. Thus, air outside the cooking appliance 10 flows into the intake passage P1 through the intake 610.

The intake passage P1 and the exhaust passage P2 extend parallelly to each other. Also, a portion of the exhaust passage P2 is disposed above the intake passage P1.

Further, as shown in FIG. 14, outside air is drawn in and combusted gas is discharged at the flow guide unit 600, so that the direction in which air flows in the intake passage is opposite the direction of combusted gas flow in the exhaust passage.

The upper barrier 270 transfers a portion of heat from combusted gas flowing through the exhaust passage P2 to the top plate 520. Therefore, food can be warmed in the warm zone of the top plate 520 correspondingly disposed above the exhaust passage P2. Also, the heat from the combusted gas flowing in the exhaust passage P2 is prevented from being transferred to the tube assembly 250 by means of the lower barrier 280.

The air within the installation space 3 of the cupboard 1 in which the cabinet 100 is installed passes through the cooling holes 110 of the cabinet 100 into the cabinet 100 and flows through the cooling passage P3.

Air drawn into the cabinet 100 from the air that circulates in the cooling passage P3 cools various components configuring the controller 400, and is discharged through the cooling holes 110.

The cooking appliance described in above embodiments is one that is used installed in a cupboard. However, this does not have to be the case, and the employed cooking appliance may be a self-standing appliance.

Also, in above embodiments, there is no provision of a separate cooling fan installed inside the cabinet to cool electrical components including the controller. For the sake of more efficient cooling of electrical components, however, a cooling fan may be provided.

The invention claimed is:

1. A cooking appliance comprising:

a cabinet;

a burner provided within the cabinet, the burner combusts a gas mixture of air and gas;

an exhaust passage in which combusted gas generated during combustion of the gas mixture flows;

an intake passage in which air that mixes with the gas flows;

a top plate provided above the burner;

a flow guide provided at a upper side of the top plate, the flow guide unit having an intake through which outside air is drawn in and an exhaust that exhausts the combusted gas to the outside;

a bracket that partitions the intake passage and the exhaust passage, and partitions that exhaust passage and the intake passage.

2. The cooking appliance according to claim 1, wherein the the top plate comprises an opening, and the flow guide covers the opening.

3. The cooking appliance according to claim 2, wherein the intake and the exhaust are aligned with the opening.

4. A cooking appliance comprising:

a cabinet;

a burner assembly provided within the cabinet, for combusting a gas mixture of air and gas;

a nozzle assembly for supplying gas to the burner assembly;

an exhaust passage in which combusted gas generated during combusting of the gas mixture flows;

an intake passage in which air for mixing with the gas flows;

a supply hole provided at a nozzle assembly for connecting a gas hose;

a discharge nozzle provided within the intake passage for supplying gas from the nozzle assembly to the burner assembly;

a top plate provided above the burner assembly, wherein air outside the cabinet is drawn into the intake passage by the jet force of the gas supplied by the discharge nozzle; and a barrier that blocks transfer of heat from the exhaust passage to the intake passage.

5. The cooking appliance according to claim 4, wherein the intake passage and the exhaust passage are parallel.

6. The cooking appliance according to claim 5, wherein the burner assembly defines at least a portion of the exhaust passage, and the burner assembly and the cabinet define at least a portion of the intake passage.

7. The cooking appliance according to claim 4, wherein a flow direction of air in the intake passage is opposite a flow direction of combusted gas in the exhaust passage.

8. The cooking appliance according to claim 4, further comprising a bracket partitioning the intake passage and the exhaust passage, the bracket defining a portion of the exhaust passage and the intake passage.

9. The cooking appliance according to claim 4, wherein air in the exhaust passage flows from front-to-rear, and air in the intake passage flows from rear-to-front.

10. The cooking appliance according to claim 4, further comprising a flow guide unit defining an exhaust through which the combusted gas in the exhaust passage is discharged, and an intake through which outside air is drawn into the intake passage.

11. The cooking appliance according to claim 10, wherein the flow guide unit is provided at a top of the cabinet.

12. The cooking appliance according to claim 10, further comprising an exhaust guide for guiding exhausting of combusted gas in the exhaust passage in a direction away from the intake.

13. A cooking appliance using gas as fuel to generate heat, comprising:

a cabinet that defines its exterior, a rear side of the cabinet being adjacent to a wall that the cooking appliance is installed;

a top plate provided at a upper side of the cabinet;

a combusting unit provided within the cabinet for combusting a gas mixture of the gas and the drawn in air;

a gas supply unit provided within the cabinet for supplying gas to the combusting unit;

a flow guide unit provided at a upper side of the top plate, the flow guide unit having an intake through which outside air is drawn in and an exhaust for exhausting the combusted gas to the outside;

an intake passage in which air drawn in through the intake flows;

an exhaust passage in which the combusted gas flows;

a bracket partitioning the intake passage and the exhaust passage; and a barrier that blocks transfer of heat from combusted gas guided by the exhaust guide to air drawn in through the intake, wherein the exhaust is located on the farther side from the wall than the intake.

14. The cooking appliance according to claim 13, further comprising a flow guide unit integrally forming the intake and the exhaust.

15. The cooking appliance according to claim 13, wherein the intake and the exhaust are disposed on an outer surface of the cooking appliance.

* * * * *